US005113745A

United States Patent [19]

Allen

[11] Patent Number: 5,113,745

[45] Date of Patent: May 19, 1992

[54] STABILIZING DEVICE FOR A GUN

[75] Inventor: Stephen Allen, Houston, Tex.

[73] Assignee: David Palmer, Lufkin, Tex. ; a part interest

[21] Appl. No.: 571,201

[22] Filed: Aug. 23, 1990

[51] Int. Cl.[5] ..... F41A 35/00

[52] U.S. Cl. ..... 89/14.05

[58] Field of Search ..... 89/14.05, 41.09, 41, 89/17; 74/5.22

[56] References Cited

U.S. PATENT DOCUMENTS

| | | | |
|---|---|---|---|
| 464,806 | 12/1891 | Tower | 89/41.09 |
| 640,051 | 12/1899 | Tower | 89/41.09 |
| 2,106,998 | 2/1938 | Fieux | 89/41.09 |
| 2,532,333 | 12/1950 | Rhyne | 74/5.22 |
| 2,534,225 | 12/1950 | Brown | 89/41.09 |
| 2,609,606 | 9/1952 | Draper et al. | 89/41.09 |
| 2,938,435 | 5/1960 | Gille | 89/41.09 |
| 3,078,728 | 2/1963 | Schlesman | 74/5 R |
| 3,144,644 | 8/1964 | Getting | 342/67 |
| 3,165,972 | 1/1965 | Cumbo | 89/14.05 |
| 3,362,073 | 1/1968 | Hausenblas | 33/228 |
| 3,396,630 | 8/1968 | Hinterthur et al. | 89/41.09 |
| 3,502,062 | 3/1970 | Shurts | 124/23.1 |
| 3,640,178 | 2/1972 | Chatham et al. | 89/41.09 |

FOREIGN PATENT DOCUMENTS

| | | | |
|---|---|---|---|
| 1269476 | 5/1968 | Fed. Rep. of Germany | 74/5.22 |

OTHER PUBLICATIONS

Guns, Apr. 1973, p. 34.

*Primary Examiner*—Stephen C. Bentley

*Attorney, Agent, or Firm*—Harrison & Egbert

[57] ABSTRACT

A stabilizing device for a gun comprising a gyroscope and a mounting assembly attached to the gyroscope for resiliently connecting the gyroscope to a gun. The mounting assembly has a gyroscope slide carriage and a first resilient member connected to the gyroscope slide carriage. The first resilient member allows the gyroscope slide carriage to move longitudinally relative to the gun. A second resilient member is interconnected to the first resilient member and to the gyroscope slide carriage. The second resilient member allows the gyroscope slide carriage to move transverse to the longitudinal axis of the gun. The first resilient member includes a pneumatic cylinder, a piston slidably received within the pneumatic cylinder, and a piston rod connected to the piston at one end and to the gyroscope slide carriage at the other end. The mounting assembly further includes a fixed frame member, a pivot frame member, and a slide rod affixed to and extending between the fixed frame member and the pivot frame member. The gyroscope slide carriage slides along the slide rods. Suitable cushions are positioned on the slide rod adjacent to the fixed frame member and the pivot frame member. The second resilient member comprises an arm pivotally connected at one end to the pivot frame member and a spring connected to the arm at the end opposite the pivot frame member. The spring is received by the fixed frame member.

22 Claims, 3 Drawing Sheets

STABILIZING DEVICE FOR A GUN

TECHNICAL FIELD

The present invention relates to guns. More particularly, the present invention relates to the use of gyroscopes for the stabilization of guns. Specifically, the present invention relates to techniques for mounting the gyroscope to a gun.

BACKGROUND ART

Throughout the years, it has been considered desirable to provide guns with great accuracy. When rifles are used for aiming at a target a very long distance away, the stability of a gun is extremely important for hitting the target. Very minor movements of the marksmen's hands or body can cause the bullet to miss the target by a wide margin. In order to correct for such minor movements, it is often necessary to place the gun on a stable surface. In certain applications in the past, tripods have been developed for stabilizing the gun. Such stabilizing can also occur by placing the gun on an adjacent fixed object.

It is often a fact that when such stabilizing devices are utilized, the minor movements in the marksmen's hands and body will still cause the target to be missed. In addition, the stabilizing devices are often cumbersome and heavy to carry. Large rocks, buildings, or other objects, often cannot be found upon which to rest the gun for firing.

In a general sense, the term "gyroscope" can be applied to any solid object rotating about a fixed point. For practical purposes, a gyroscope consists of an axially symmetrical rotating body. It has certain rotational momentum ("spin") which depends upon the mass of the gyroscope, the square of the distance of the individual particles of mass to the axis of rotation, and on the speed of rotation. To increase the rotational momentum, the gyroscope can advantageously be constructed as a disk with a thickened rim, so that most of its mass is concentrated as far from the axis as possible. The significant feature of a gyroscope is that the momentum and the rotational axis preserve their direction so long as no external forces act upon the gyroscope. Because of this tendency to keep the direction of its axis constant in space, the gyroscope can suitably be used for the stabilization of movements.

In the past, it is believed that gyroscopes have been attached to rifles for the purpose of stabilization. Unfortunately, these experiments failed dramatically. It was found that the shock and recoil of firing a gun would quickly destroy the gyroscope fixed to the gun. It was found that the practical life of the gyroscope was very small when the gyroscope was fixed to a gun.

It is an object of the present invention to provide a stabilizer for a gun.

It is another object of the present invention to provide an assembly which resiliently mounts a gyroscope to a gun.

It is another object of the present invention to provide a stabilizer for a gun that has a long life, minimal weight, and easy use.

These and other objects and advantages of the present invention will become apparent from a reading of the attached specification and appended claims.

SUMMARY OF THE INVENTION

The present invention is an apparatus that comprises a gun, a gyroscope, and a mounting assembly that is connected to the gun and the gyroscope. The mounting assembly serves the purpose of resiliently connecting the gyroscope to the gun. The gun has a bracket that is positioned on the underside of the gun for the threaded receipt of the mounting assembly. The gyroscope also has a threaded portion that extends upwardly for connection to the mounting assembly.

The mounting assembly of the present invention provides two axes of resiliency between the gun and the gyroscope. The first axis of resiliency is along the longitudinal axis of the gun. The second axis of resiliency is transverse to this longitudinal axis.

The mounting assembly specifically comprises a gyroscope slide carriage, a first resilient member connected to the gyroscope slide carriage, and a second resilient member that is interconnected to the first resilient member and to the gyroscope slide carriage. The first resilient member allows the gyroscope slide carriage to move longitudinally relative to the gun. The second resilient member allows the gyroscope slide carriage to move in a direction transverse to the longitudinal axis of the gun.

The first resilient member comprises a pneumatic cylinder, a piston slidably received within the pneumatic cylinder, and a piston rod that is connected to the piston and connected to the gyroscope slide carriage. The pneumatic cylinder is of an adjustable pneumatic pressure. The piston rod is a telescoping member which has one end connected to the piston and the other end connected to the gyroscope slide carriage. The air pressure within the pneumatic cylinder serves as air resistance to the movement of the gyroscope slide carriage during the firing of the gun.

The mounting assembly further comprises a fixed frame member, a pivot frame member, and first and second slide rods affixed to and extending between the fixed frame member and the pivot frame member. The gyroscope slide carriage is slidably mounted onto the first and second slide rods. The first and second slide rods are arranged parallel to one another. The first and second slide rods include an anti-friction coating, such as TEFLON (TM). The first resilient member extends between the first and second slide rods and serves to control the movement of the gyroscope slide carriage relative to the slide rods. Suitable cushions are positioned on the first and second slide rods adjacent to the fixed frame member and to the pivot frame member. These cushions serve to prevent contact of the gyroscope slide carriage with the fixed frame member or the pivot frame member.

The second resilient member comprises an arm that is pivotally connected at one end to the pivot frame member and a spring that is connected to the arm at the end opposite the pivot frame member. The arm includes a threaded member on its upper surface for connection to the gun. The spring is received by the fixed frame member. The spring serves to act as resistance to the movement of the arm during the firing of the gun. The second resilient member also includes a shock-absorbing member fastened between the arm and the fixed frame member. This shock-absorbing member serves to prevent contact between the arm and the fixed frame member.

By allowing resiliency between the gyroscope and the gun, the mounting assembly of the present invention preserves the life of the gyroscope while still providing for the stability of the gun.

DETAILED DESCRIPTION OF THE INVENTION

Figure 1:
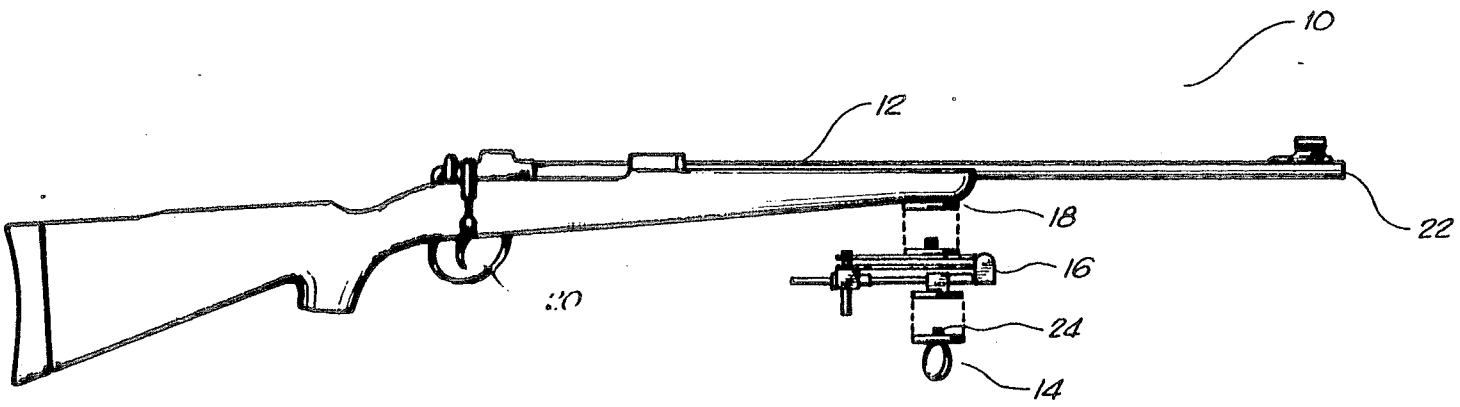
FIG. 1 is an exploded view in side elevation of the gun, the mounting assembly, and the gyroscope of the present invention.

Referring to FIG. 1, there is shown at 10 the apparatus of the present invention. Apparatus 10 comprises a gun 12, a gyroscope 14, and the mounting assembly 16. The mounting assembly 16 is provided so a to resiliently mount the gyroscope 14 to the underside of rifle 12. Rifle 12 is a conventional rifle used for shooting at targets a long distance away. On the underside of rifle 12 is a bracket 18. Bracket 18 is fixed to the underside of rifle 12 between the trigger 20 and the end 22. It is desirable that the bracket 18 be positioned so as to accentuate the balancing of the rifle.

Gyroscope 14 is a camera-style gyroscope manufactured by Kenlab of Old Lime, Conn. When used with cameras, this gyroscope 14 is described as a "invisible tripod". Gyroscope 14 includes a threaded connector portion 24 at its upper surface. This threaded connector 24 allows the gyroscope 14 to be fastened to the mounting assembly 16. Bracket 18 of rifle 12 also includes a threaded opening therein for the receipt of a threaded member from the mounting assembly 16. These three components of the present invention are threadedly connected together so as to provide the advantage of stability during the firing of gun 12.

It should be noted that the apparatus illustrated in FIG. 1 shows the mounting assembly 16 in its skeleton form. In keeping with the present invention, a suitable housing or body can be arranged over the exterior of mounting assembly 16 and/or gyroscope 14 so as to conceal the operation of the mounting assembly 16 and to maintain safety. In operation, the gyroscope 14 will utilize its spinning motion so as to gyroscopically stabilize the gun 12. As such, the aim of the gun 12 is improved, the accuracy of the firing is improved, and the errors due to shaking or jiggling are reduced.

Also, the use of the mounting assembly 16 for resiliently connecting the gyroscope 14 to the rifle 12 eliminates much of the shock from the firing and recoil from acting on the gyroscope 14. Since the recoil of the rifle is generally predictable, that is, a backward motion and an upward motion, the mounting assembly 16, to be effective, can simply accommodate that motion. As such, the present invention achieves its advantages by using the mounting assembly 16 to provide two axes of resiliency in the connection between the gyroscope 14 and the rifle 12.

Figure 2:
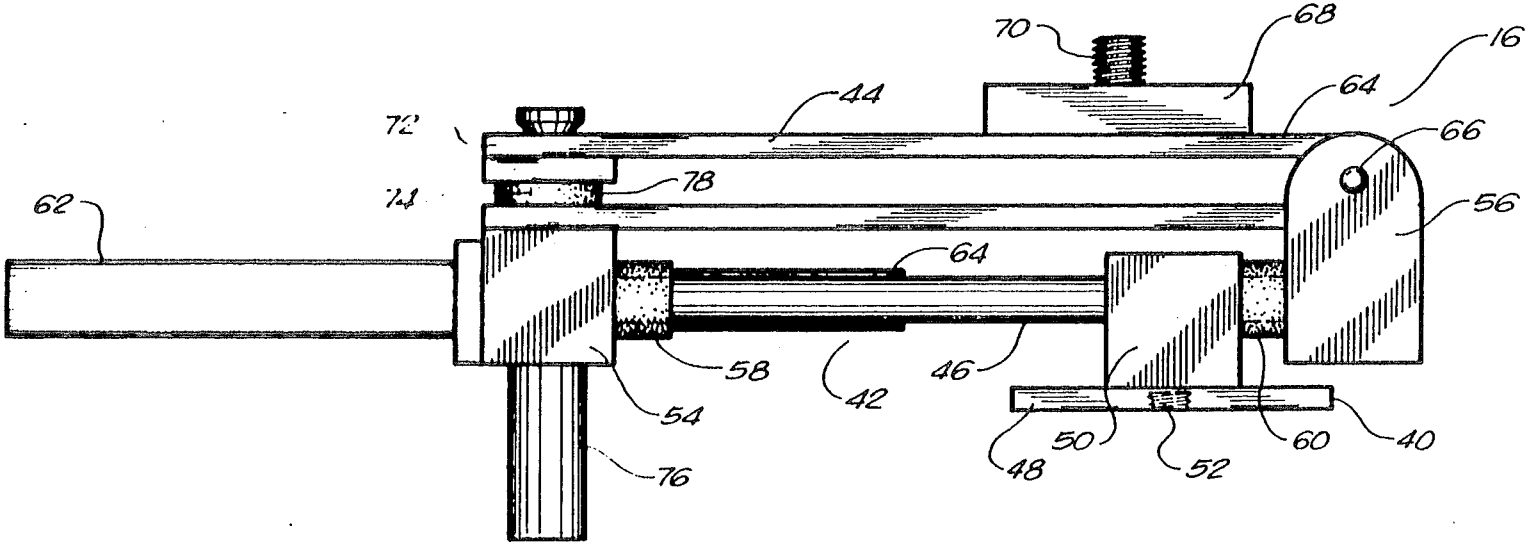
FIG. 2 is an isolated view, in side elevation, of the mounting assembly of the present invention.

In FIG. 2, the mounting assembly 16 is shown in greater detail. The mounting assembly 16 comprises a gyroscope slide carriage 40, a first resilient member 42, and a second resilient member 44. The first resilient member 42 is connected to the gyroscope slide carriage 40 for the purposes of allowing the gyroscope slide carriage 40 to move longitudinally along slide rod 46 relative to the motion of the gun. The second resilient member 44 is an arm that is interconnected to the first resilient member 42 and to the gyroscope slide carriage 40 so as to allow the gyroscope slide carriage 40 to move in a direction transverse to the longitudinal axis of the gun. In this manner, the mounting assembly 16 provides the required resiliency between the gyroscope and the gun.

The gyroscope slide carriage 40 has a bottom plate 48 which is connected to slide body 50. The bottom plate 48 includes a threaded opening 52 centrally located therein for receiving the threaded member of the gyroscope 14. The gyroscope 14 may be threadedly attached within the threaded opening 52 of the gyroscope slide carriage 40. In this manner, the top plate of the gyroscope 14 will abut the bottom plate 48 of the gyroscope slide carriage 40. Slide body 50 is adapted to slide along slide rod 46 in a virtually frictionless manner.

The mounting assembly 16 includes a fixed frame member 54 and a pivot frame member 56 located at opposite ends of the slide rod 46. Slide rod 46 is rigidly affixed to the fixed frame member 54 and the pivot frame member 56. The slide rod 46 may be coated with a TEFLON (TM) material or other anti-friction coating. The slide body 50 of the gyroscope slide carriage 40 has a tubular opening that slides over the exterior surface of slide rod 46. A first cushion 58 is positioned over the slide rod 46 adjacent to the fixed frame member 54. Similarly, another cushion 60 is positioned over the slide rod 46 adjacent to the pivot frame member 56. These cushions are positioned on slide rod 46 on opposite sides of the gyroscope slide carriage 40. These cushions 58 and 60 are designed so as to prevent contact of the gyroscope slide carriage 40 with the fixed frame member 54 or the pivot frame member 56.

The movement of the gyroscope slide carriage 40 along the longitudinal axis of the gun 12 is controlled by a pneumatic cylinder 62. A piston rod 64 extends outwardly from the pneumatic cylinder 62 so as to resist the movement of the gyroscope slide carriage 40 from the pivot frame member 56 to the fixed frame member 54. The configuration of the pneumatic cylinder 62 and telescoping piston rod 64 is to be described hereinafter. A second resilient member 44 comprises an arm 64 that is connected at pivot point 66 to pivot frame member 56. Arm 64 has a plate 68 affixed to its upper surface that contains the threaded member 70. As stated previously, the threaded member 70 is adapted for threaded insertion into the plate 18 of the rifle 12. Arm 64 extends from pivot frame member 56 to the fixed frame member 54. At the end 72 of arm 64, is a shaft 74 extending vertically downward therefrom. Shaft 74 is received by pivot spring cover 76. Within pivot spring cover 76 is a spring that is designed to resist the downward movement of the end 72 of arm 64. A cushion 78 is interposed between the end 72 of arm 64 and the top of the fixed frame member 54. The cushion 78 surrounds the shaft 74 so as to prevent contact between the end 72 of arm 64 and the top of the fixed frame member 54. As described hereinafter, the cushion 78 acts as a shock-absorbing member. In use, the second resilient member 44 accommodates the upward motion of the rifle during firing and recoil. As such, the second resilient member 44 provides the necessary resiliency in the direction transverse to the longitudinal axis of the gun.

Figure 3:
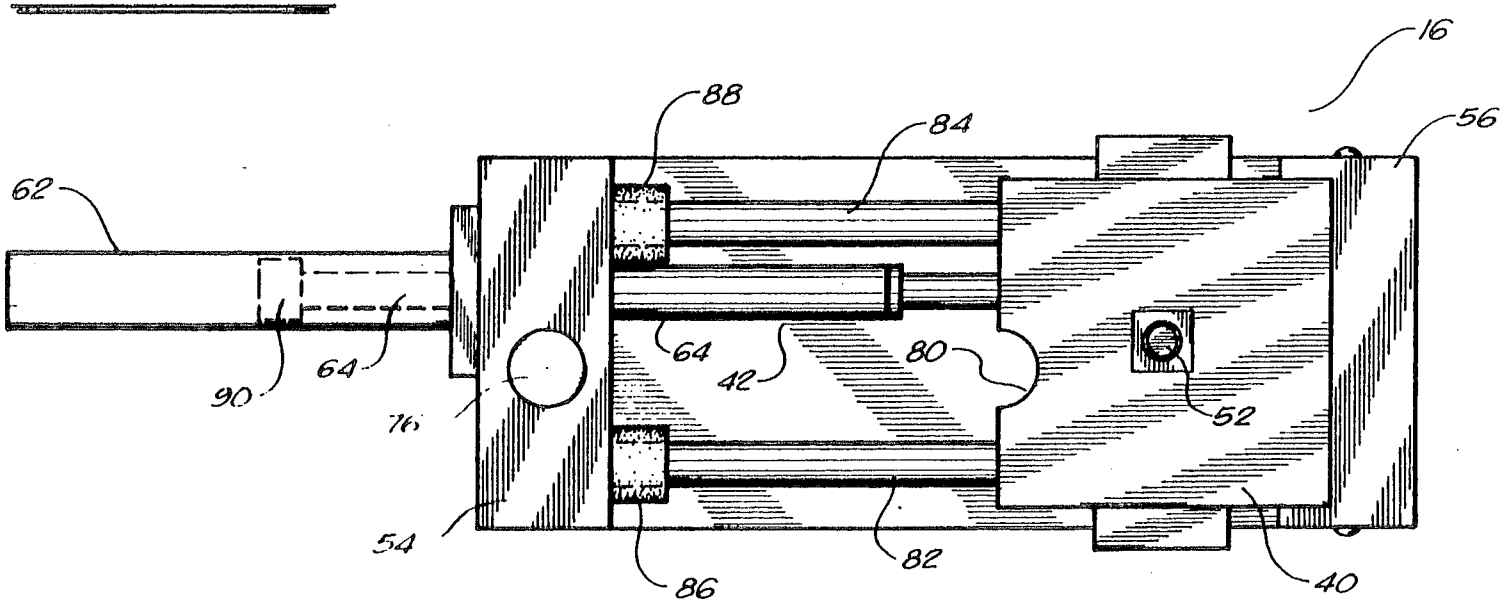
FIG. 3 is a bottom view of the mounting assembly in accordance with the preferred embodiment of the present invention.

FIG. 3 is a bottom view showing the configuration of the mounting assembly 16. Specifically, in FIG. 3, it can be seen that the gyroscope slide carriage 40 includes a threaded opening 52 located centrally at the bottom of the gyroscope slide carriage 40. The bottom of the gyroscope slide carriage 40 is a flat square plate. An indentation 80 is formed along on edge of the gyroscope slide carriage 40 so as to accommodate any movement of the gyroscope slide carriage 40 into the area of the pivot spring cover 76. The gyroscope slide carriage 40 has the capacity of moving from the fixed frame member 54 to the pivot frame member 56 along the first slide rod 82 and the second slide rod 84. As can be seen, the first slide rod 82 and the second slide rod 84 are tubular members that extend from the fixed frame member 54 to the pivot frame member 56. The first slide rod 82 is positioned in parallel to the second slide rod 84. As stated previously, each of the slide rods 82 and 84 may be coated with an anti-friction coating. Cushions 86 and 88 are provided at each end of the slide rods 82 and 84, respectively. Cushions 86 and 88 serve to prevent the abutment of the gyroscope slide carriage 40 with the fixed frame member 54. As such, the cushions 86 and 88 prevent any sharp jarring that can occur by the attached gyroscope.

The first resilient member 42 is shown in greater detail in FIG. 3. The first resilient member 42 includes pneumatic cylinder 62, piston rod 64, and a piston 90. The piston 90 is slidably received by the interior of the pneumatic cylinder 62. The piston rod 64 is connected to one side of the piston 90 and extends outwardly through the fixed frame member 54. The piston rod 64 is a telescoping member that extends to and is affixed to the gyroscope slide carriage 40. The pneumatic pressure within pneumatic cylinder 62 is adjustable so as to present varying resistance to the movement of the gyroscope slide carriage 40 along the slide rods 82 and 84. For example, if a gun with a strong recoil is used, then it may be desirable to have greater pneumatic pressure within pneumatic cylinder 62. On the other hand, when using a gun with a gentle recoil, less pneumatic pressure may be required in pneumatic cylinder 62.

As can be seen in FIG. 3, the pivot spring cover 76 extends outwardly beyond the bottom surface of the fixed frame member 64. The spring utilized within the pivot spring cover 76 can be selected in relation to the strength of the recoil of the rifle used. A stronger spring will resist the jarring effect of strong recoil.

The mounting assembly 16 of the present invention achieves many advantages. First, the mounting assembly 16 allows a gyroscope to be resiliently mounted to a rifle. As such, the stabilizing effect of the gyroscope can be applied to rifle usage. In actual usage of the rifle, the gyroscopic effects maximize the stability of the rifle and offer great resistance to accidental jerks and jiggles. By the use of a gyroscope connected to the gun, much greater accuracy can be achieved during the aiming of the rifle.

In the past, any attempts to join a gyroscope with a rifle have been through rigid affixation. This has caused damage to the gyroscope and a quick loss of the gyroscopic benefits. However, the present invention, by resiliently mounting the gyroscope to the gun, achieves the same desired effect of stability while eliminating any damage to the gyroscope during firing and recoil. As such, the gyroscope can have a lengthy life and maximize the benefits to the user.

The foregoing disclosure and description of the invention is illustrative and explanatory thereof, and various changes in the details of the illustrated apparatus can be made within the scope of the appended claims without departing from the spirit of the invention. The present invention should only be limited by the following claims and their legal equivalents.

I claim:

1. An apparatus comprising:

a gun;

a gyroscope; and mounting means connected to said gun and to said gyroscope, said mounting means for resiliently connecting said gyroscope to said gun, said mounting means comprising:

a gyroscope slide carriage; and a first resilient member connected to said gyroscope slide carriage, said first resilient member for allowing said gyroscope slide carriage to move longitudinally relative to said gun.

2. The apparatus of claim 1, said gun having a bracket positioned on the underside of said gun, said bracket having a threaded portion for the receipt of said mounting means.

3. The apparatus of claim 1, said gyroscope having a threaded portion extending outwardly therefrom for connection to said mounting means.

4. The apparatus of claim 1, said mounting means having two axes of resiliency.

5. The apparatus of claim 1, further comprising:

a second resilient member interconnected to said first resilient member and to said gyroscope slide carriage, said second resilient member for allowing said gyroscope slide carriage to move transverse to the longitudinal axis of said gun.

6. The apparatus of claim 5, said first resilient member comprising:

a pneumatic cylinder;

a piston slidably received by said pneumatic cylinder; and a piston rod connected to said piston, said gyroscope slide carriage affixed to said piston rod.

7. The apparatus of claim 6, said pneumatic cylinder being of adjustable pneumatic pressure, said piston rod being a telescoping member.

8. The apparatus of claim 5, said mounting means further comprising:

a fixed frame member;

a pivot frame member; and a first slide rod affixed to and extending between said fixed frame member and said pivot frame member, said first slide rod being slidably received by said gyroscope slide carriage.

9. The apparatus of claim 8, further comprising:

a second slide rod extending parallel to said first slide rod, said second slide rod affixed to and extending between said fixed frame member and said pivot frame member, said second slide rod being slidably received by said gyroscope slide carriage, said first resilient member connected to said gyroscope slide carriage between said first slide rod and said second slide rod, said first and second slide rods having an anti-friction coating; and cushion means positioned on said first and second slide rods adjacent to said fixed frame member and said pivot frame member, said cushion means for preventing contact of said gyroscope slide carriage with said fixed frame member and said pivot frame member.

10. The apparatus of claim 8, said second resilient member comprising:

an arm pivotally connected at one end to said pivot frame member, said arm having a threaded member for connection to said gun; and a spring connected to said arm at the end opposite said pivot frame member, said spring received by said fixed frame member.

11. The apparatus of claim 10, further comprising:

a shock-absorbing member fastened between said arm and said fixed frame member, said shock-absorbing member for preventing contact between said arm and said fixed frame member.

12. A stabilizing device for a gun comprising:

a gyroscope; and a mounting means attached to said gyroscope for resiliently connecting said gyroscope to said gun, said mounting means comprising:

a gyroscope slide carriage; and a first resilient member connected to said gyroscope slide carriage, said first resilient member for allowing said gryoscope slide carriage to move longitudinally relative to said gun.

13. The device of claim 12, further comprising:

a second resilient member interconnected to said first resilient member and to said gyroscope slide carriage, said second resilient member for allownig said gyroscope slide carriage to move vertically relative to said gun.

14. The device of claim 13, said first resilient member comprising:

a pneumatic cylinder;

a piston slidably received by said pneumatic cylinder; and a piston rod connected to said piston, said gyroscope slide carriage affixed to said piston rod.

15. The device of claim 13, said mounting means further comprising:

a fixed frame member;

a pivot frame member; and a first slide rod affixed to and extending between said fixed frame member and said pivot frame member, said first slide rod being slidably received by said gyroscope slide carriage;

a second slide rod extending parallel to said first slide rod, said second slide rod affixed to and extending between said fixed frame member and said pivot frame member, said second slide rod being slidably received by said gyroscope slide carriage, said first resilient member connected to said gyroscope slide carriage between said first slide rod and said second slide rod, said first and second slide rods having an anti-friction coating; and cushion means positioned on said first and second slide rods adjacent to said fixed frame member and said pivot frame member, said cushion means for preventing contact of said gyroscope slide carriage with said fixed frame member and said pivot frame member.

16. The device of claim 13, said second resilient member comprising:

a fixed frame member;

an arm pivotally connected at one end to said pivot frame member, said arm having a threaded member for connection to a gun;

a spring connected to said arm at the end opposite said pivot frame member, said spring received by said fixed frame member; and a shock-absorbing member fastened between said arm and said fixed frame member, said shock-absorbing member for preventing contact between said arm and said fixed frame member.

17. A device for resiliently connecting a gyroscope to a gun comprising:

a gyroscope slide carriage; and a first resilient member connected to said gyroscope slide carriage, said first resilient member for allowing said gyroscope slide carriage to move longitudinally relative to said gun.

18. The device of claim 17, further comprising:

a second resilient member interconnected to said first resilient member and to said gyroscope slide carriage, said second resilient member for allowing said gyroscope slide carriage to move transverse to the longitudinal axis of said gun.

19. The device of claim 17, said first resilient member comprising:

a pneumatic cylinder;

a piston slidably received by said pneumatic cylinder; and a piston rod connected to said piston, said gyroscope slide carriage affixed to said piston rod.

20. The device of claim 17, further comprising:

a fixed frame member;, a pivot frame member;

a first slide rod affixed to and extending between said fixed frame member and said pivot frame member, said first slide rod being slidably received by said gyroscope slide carriage;

a second slide rod extending parallel to said first slide rod, said second slide rod affixed to and extending between said fixed frame member and said pivot frame member, said second slide rod being slidably received by said gyroscope slide carriage; and cushion means positioned on said first and second slide rods adjacent to said fixed frame member and said pivot frame member, said cushion means for preventing contact of said gyroscope slide carriage with said fixed frame member and said pivot frame member.

21. The device of claim 18, said second resilient member comprising:

a fixed frame member;

a pivot frame member;

an arm pivotally connected at one end to said pivot frame member, said arm having a threaded member for connection to a gun; and a spring connected to said arm at the end opposite said pivot frame member, said spring received by said fixed frame member.

22. The device of claim 21, further comprising:

a shock-absorbing member fastened between said arm and said fixed frame member, said shock-absorbing member for preventing contact between said arm and said fixed frame member.

* * * * *